United States Patent [19]

Gräff

[11] Patent Number: 4,481,721

[45] Date of Patent: Nov. 13, 1984

[54] METHOD OF AND AN APPARATUS FOR DRYING PULVERULENT MATERIALS

[76] Inventor: Roderich W. Gräff, Kollwitzweg 19, 6100 Darmstadt-Arheilgen, Fed. Rep. of Germany

[21] Appl. No.: 126,826

[22] Filed: Mar. 3, 1980

Related U.S. Application Data

[63] Continuation of Ser. No. 912,037, Jun. 2, 1978, abandoned.

[30] Foreign Application Priority Data

Jun. 8, 1977 [DE] Fed. Rep. of Germany ..... 2725839

[51] Int. Cl.[3] ..... F26B 3/16

[52] U.S. Cl. ..... 34/33; 34/102; 34/181; 34/212

[58] Field of Search ..... 34/33, 77, 102, 181, 34/182, 212, 213, 225, 236

[56] References Cited

U.S. PATENT DOCUMENTS

| | | | |
|---|---|---|---|
| 2,207,360 | 7/1940 | Spellacy | 34/102 |
| 2,634,513 | 4/1953 | Ladd et al. | 34/102 |
| 2,799,947 | 7/1957 | Elwess | 34/15 |
| 3,913,239 | 10/1975 | Burgin | 34/102 |
| 4,142,302 | 3/1979 | Primus | 34/212 |

*Primary Examiner*—Larry I. Schwartz
*Attorney, Agent, or Firm*—Michael J. Striker

[57] ABSTRACT

A body of pulverulent material is confined in a receptacle, and a screw conveyor having a vertical axis conveys a predetermined quantity of the material per unit of time in the upward direction. The amount of the pulverulent material which is being conveyed is such that it fills the space between the turns of the helical conveyor screw of the screw conveyor, which is surrounded by a jacket, only in part, thus leaving a passage in the screw conveyor through which a stream of drying air is conveyed in contact with the pulverulent material so that the drying air withdraws moisture from the material. The rotational speed and/or the pitch or spacing of the consecutive turns of the conveyor screw is so selected that only such an amount of the pulverulent material enters through an opening in the jacket of the screw conveyor while the space between two consecutive turns is juxtaposed with the opening as to only partially fill such a space.

10 Claims, 3 Drawing Figures

METHOD OF AND AN APPARATUS FOR DRYING PULVERULENT MATERIALS

This is a continuation of application Ser. No. 912,037, filed June 2, 1978 now abandoned.

BACKGROUND OF THE INVENTION

The present invention relates to the drying of particulate bulk materials in general, and more particularly to the drying of pulverulent materials, (powders).

It is already known to dry particulate materials, especially granulated bulk materials such as, for instance, granules of synthetic plastic material, by passing heated dry air through a body consisting of the granules. The drying air heats the granules and accepts moisture which is released from the granules to carry the moisture out of the drying receptacle. In this connection, it is already known to utilize the ambient air, which is preheated to the desired temperature, as the drying medium, and then to discharge the moisturized air into the ambient atmosphere. However, it has been established that a much more economical solution is obtained when a closed circuit is provided for the drying air, that is, when the moisturized air is passed through a dehumidifying or demoisturizing arrangement subsequent to its passage through the body of the granular particulate material, and then reintroduced into the receptacle which contains the body of the granular particulate material.

As advantageous as this method and the associated apparatus may be for demoisturizing or drying granular particular material, it has been established that this method, for all intents and purposes, cannot be used in connection with pulverulent bulk materials, inasmuch as the resistance of the body of the pulverulent particulate material to the passage of the drying air therethrough is so great that only uneconomically small amounts of the drying air can be passed through the body of the pulverulent material. As a result of this, it would be possible to, on the one hand, heat the pulverulent material to the desired temperature and, on the other hand, contact the pulverulent material sufficiently well with the dry air, only in an uneconomically long period of time.

In order to avoid this disadvantageous situation, it would be possible to very considerably increase the pressure of the warm drying air so as to, in effect, transform the body of the pulverulent material into a fluidized bed through which the drying air can flow in substantial amounts. However, even this approach is disadvantageous inasmuch as certain amounts of the pulverulent material are entrained in the drying air and are carried thereby out of the confining receptacle. So, while it is true that a more rapid heating of the material and also a more rapid withdrawal of the moisture from the pulverulent material is obtained when this expedient is resorted to, it is also disadvantageous in that it is necessary to remove the entrained particulate material from the humid drying air downstream of the particulate body as considered in the direction of flow of the drying air.

SUMMARY OF THE INVENTION

Accordingly, it is a general object of the present invention to avoid the disadvantages of the prior art.

More particularly, it is an object of the present invention to present a method of drying particulate, especially pulverulent, materials which is not possessed of the disadvantages of the prior art methods.

Still another object of the present invention is to develop a method of the above-mentioned type which allows to thoroughly dry particulate, especially pulverulent materials, within an economically supportable period of time and at an economical energy consumption.

A further object of the present invention is to devise a method which permits to dry the material present at all locations of the particulate body, without leaving any regions of still moist material in the body.

A concomitant object of the present invention is to so construct an apparatus for performing the above-mentioned method as to be simple in construction, inexpensive to manufacture, and reliable in operation nevertheless.

In pursuance of these objects and others which will apparent hereafter, one feature of the present invention resides in a method of drying particulate, especially pulverulent, materials, which, briefly stated, comprises the steps of forming a body of the respective material to be dried; so introducing a quantity of the material from the body into a confining space as to fill only a part of the confining space; and passing a gaseous drying medium through the remainder of the confining space for the drying medium to contact and withdraw moisture from the quantity of the material. Advantageously, the method of the present invention further comprises the step of advancing the quantity of the material in a predetermined path and discharging the material from the path at least at one discharging location. Then, the introducing step includes replenishing the quantity of the material from the body at least at one replenishing location of the path. Then, it is further advantageous when the drying medium is conducted, during the passing step, along the above-mentioned path between the replenishing and discharging locations. It is especially advantageous when the quantity of the material is conveyed in a helical path, and when the stream of the drying medium is conducted in another helical path adjacent the above-mentioned helical path in which the quantity of the material is being conveyed between the above-mentioned locations.

When the method is performed in the manner outlined above, it is achieved that the resistance to the flow of the drying air or a similar drying medium is very low so that it is sufficient to maintain the pressure of the drying air at an economically low level. As a result of this, there are not encountered, even regionally, any high flow velocities at which the particles of the pulverulent material could be entrained in the drying medium. The drying air contacts the pulverulent material at a relatively large surface area so that the pulverulent material is heated to a degree sufficient for the pulverulent material to transfer its moisture contents to the drying air.

A further advantage of this approach is to be seen in the fact that, as a result of the conveyance of the particulate material, different particles of the pulverulent material come into contact with the drying air at different times inasmuch as different ones of the particles of the particulate material happen to be located at the surface of the layer of the pulverulent material which is exposed to the action of the drying air. In this manner, given a sufficiently long drying period, the material of the entire body of the pulverulent material will be uniformly exposed to the action of the drying air.

A further advantageous aspect of the present invention resides in an apparatus for drying particulate, especially pulverulent, materials, which is especially suited for performing the above-discussed method, which apparatus comprises means for receiving a body of the respective material to be dried; means for confining a quantity of the material; means for so introducing the quantity of the material from the receiving means into the confining means as to fill only a part of the latter; and means for passing a gaseous drying medium through the remainder of the confining means for the drying medium to contact and withdraw moisture from the quantity of the material. Here again, it is advantageous when the confining means includes means for advancing the quantity of the material in a predetermined path and for discharging the material from the path at least at one discharging location, the introducing means then being operative for replenishing the quantity of the material at least at one replenishing location of the path. In this context, it is especially advantageous when the advancing means includes a screw conveyor, especially a vertically oriented screw conveyor, which includes a conveyor screw and a jacket surrounding the conveyor screw. Then, the introducing means includes at least one opening in the jacket which communicates the interior of said jacket with the receiving means at an elevation of the latter where the body of the material is present. Under these circumstances, it is especially advantageous when the passing means includes means for admitting a stream of the drying medium into the screw conveyor at one of the locations of the path for the drying medium to flow through the screw conveyor along the path toward the other of the locations. It is further advantageous in this context to provide means for rotating the conveyor screw about an axis, and to give the opening such a size that only that amount of the material of the body can penetrate therethrough during the period of time when the space between two successive turns of the rotating conveyor screw is juxtaposed with the opening as to only partially fill the space. Then, it is advantageous to so coordinate the pitch and other dimensions of the conveyor screw and, or the rotary speed of the conveyor screw about the above-mentioned axis, with the cross section of the opening that the above-mentioned partial filling of the spaces between the turns of the conveyor screw is achieved.

When the apparatus of the present invention is constructed in the above-mentioned manner, the supplied warm drying air can flow through the remainder of the space between the successive turns of the screw, especially upwardly. The drying air transmits its heat content to the pulverulent material to be dried, partially immediately as a result of its contact with the exposed surface of the layer of the particulate material conveyed by the conveyor screw, partially mediately through the turns of the conveyor screws and via the jacket which surrounds the conveyor screw.

Because of its nature, this apparatus can be utilized only for intermittently drying separate charges of the particulate or pulverulent material. In order to obtain a continuous drying operation of sorts, it can be economical and advantageous, as proposed by the present invention, to arrange several units each of which includes the above-mentioned receiving and confining means, in tandem, or in series with one another, providing means for transferring the material from one to the other of the units. Under these circumstances, the passing means is advantageously operative for introducing the drying medium into the above-mentioned other unit first, and for conducting the drying medium from the other unit into the above-mentioned one unit for passage through the latter only after the drying medium has passed through the above-mentioned other unit.

The particulate or pulverulent material which is to be dried is transferred, in an intermittent manner, from the one to the other following unit at certain time intervals. Inasmuch as the dry warm drying air first enters that unit which is reached by the material being dried last, it is achieved that the heat content of the drying air is distributed, in an advantageous manner, over the entire assembly of the units and is utilized to the utmost degree, while the air finally leaves the first-mentioned unit at an optimally low temperature which is also advantageous for the efficiency of the air-dehumidifying arrangement in which the drying air charged with the moisture withdrawn from the particulate material is again dehumidified. Furthermore, the almost completely dry particulate material is dried in the last one of the units in the assembly by the drying air which had not yet picked up any moisture in any preceding one of the units of the assembly, so that an optimum drying effect and complete drying of the particulate material is achieved in this last unit of the assembly.

A further advantageous aspect of the present invention, which reflects itself in a further reduction of the time period needed for completely drying the pulverulent or other particulate material, resides in the fact that heating means is provided for heating the conveyor screw and/or the jacket of the screw conveyor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
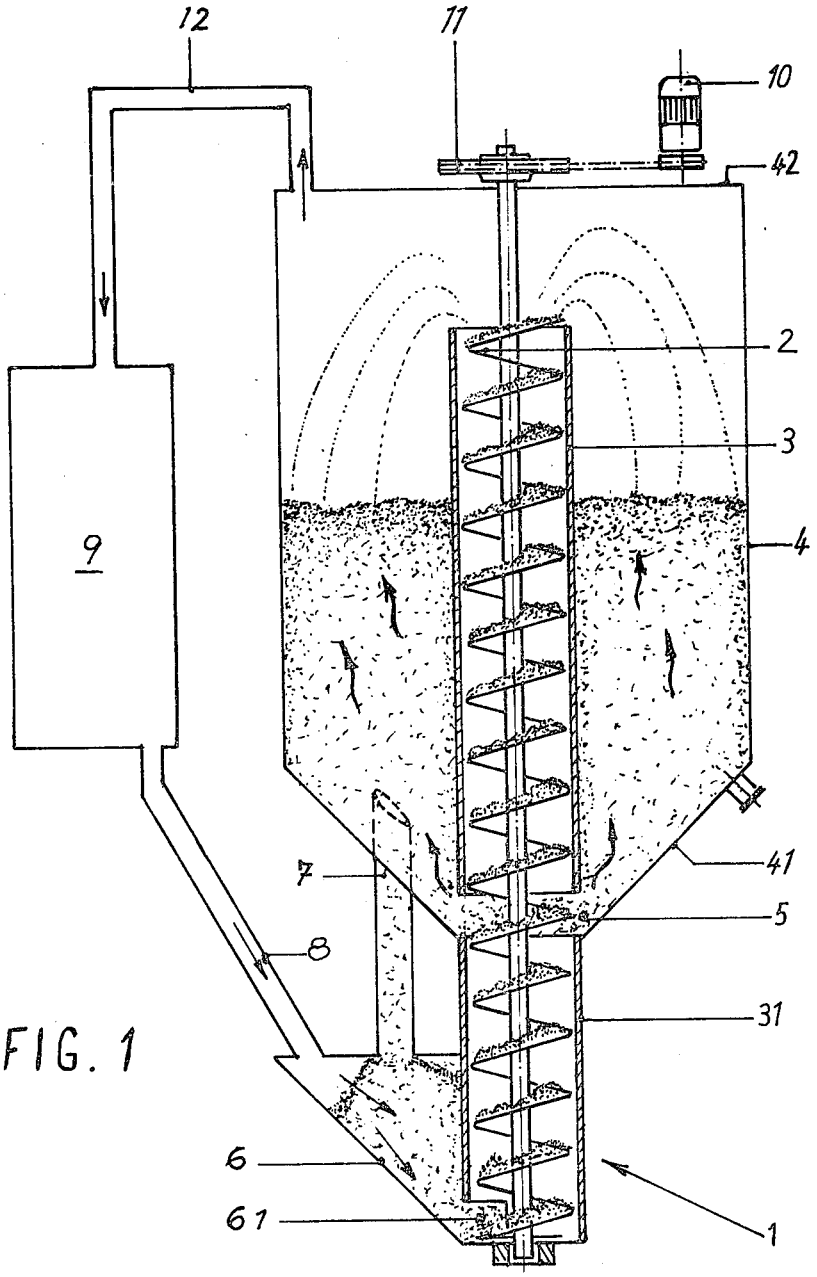
FIG. 1 is a somewhat diagrammatic partially sectioned side elevational view of the arrangement of the present invention.

Referring now to the drawing in detail, and first to FIG. 1 thereof, it may be seen that the reference numeral 1 has been used to indicate a drying and mixing apparatus in toto. The drying and mixing apparatus 1 includes a screw conveyor 2, 3 which includes a conveyor screw 2 and a jacket 3 which surrounds the conveyor screw 2. It may also be seen that the conveyor screw 2 is mounted for rotation about a vertical axis.

The drying and mixing apparatus 1 further contains a receptacle 4 which has a funnel-shaped bottom 41. The jacket 3 includes a lower portion 31 which merges with the bottom 41 of the receptacle 4. The upper portion of the jacket 3 which is located in the interior of the receptacle 4 forms, together with the funnel-shaped bottom 41 of the receptacle 4, a gap or opening 5 through which the particulate material of a body which is confined in the interior of the receptacle 4 can penetrate from the exterior into the interior of the jacket 3.

A casing 6 is arranged laterally at the lower portion 31 of the jacket 3, the interior of the casing 6 being in communication, via a tube 7, with the interior of the receptacle 4 at the bottom 41. On the other hand, a warm air conduit 8 communicates the interior of the casing 6 with an air-dehumidifying arrangement 9 of a conventional construction.

The pitch, the distance between the consecutive turns, and/or the rotary speed of the conveyor screw 2 are so selected that the pulverulent or other particulate material of the body confined in the interior of the casing 6 enters and only partially fills the space between the consecutive turns of the conveyor screw 2 at the lower end of the latter through an opening 61 which communicates the interior of the casing 6 with the interior of the jacket 3. On the other hand, the material of the body confined in the interior of the receptacle 4 penetrates through the opening 5 from the funnel-shaped bottom portion 41 of the receptacle 4 into the interior of the jacket 3. The conveyor screw 2 is rotated in such a direction that the pulverulent material is transported upwardly over the entire length of the screw conveyor 2, 3, while the particulate material does not completely fill the space bounded by the consecutive turns of the conveyor screw 2 and the jacket 3 of the screw conveyor 2, 3.

The warm air, which is introduced through the conduit 8 into the interior of the casing 6 also passes through the opening 61 into the interior of the jacket 3 and, because of the fact that the space between the successive turns of the conveyor screw 2 is not completely filled with the particulate material, this drying air can flow through the remainder of the space between the consecutive turns of the conveyor screw 2 and in a helical path around the axis of the latter from below to above. The drying air which has picked up moisture from the particulate material during its contact therewith and the temperature of which has dropped during the drying operation, is discharged from the interior of the receptacle 4 at a top region 42 of the receptacle 4 and is conducted through a conduit 12 back into the dehumidifying arrangement 9 where it is deprived of moisture preparatory to a renewed introduction thereof into the casing 6. The top 42 of the receptacle 4 also supports a driving motor 10 and a transmission 11 which together constitute a drive which rotates the conveyor screw 2 about its axis.

It may also be seen from FIG. 1 that, while most of the drying air will flow in the helical path upwardly through the spaces between the consecutive turns of the conveyor screw 2, some of the drying air will escape through the opening 5 and penetrate through the body of the particulate material confined in the receptacle 4 outside the jacket 3, as indicated by the arrows. This penetration of the drying air directly through the body of the particulate material is rendered possible due to the fact that the material is relatively loose, as a result of its withdrawal at the funnel-shaped bottom portion 41 of the receptacle 4, and of the gradual deposition of the particulate material at the top surface of the body of the particulate material confined in the interior of the receptacle 4.

Figure 2:
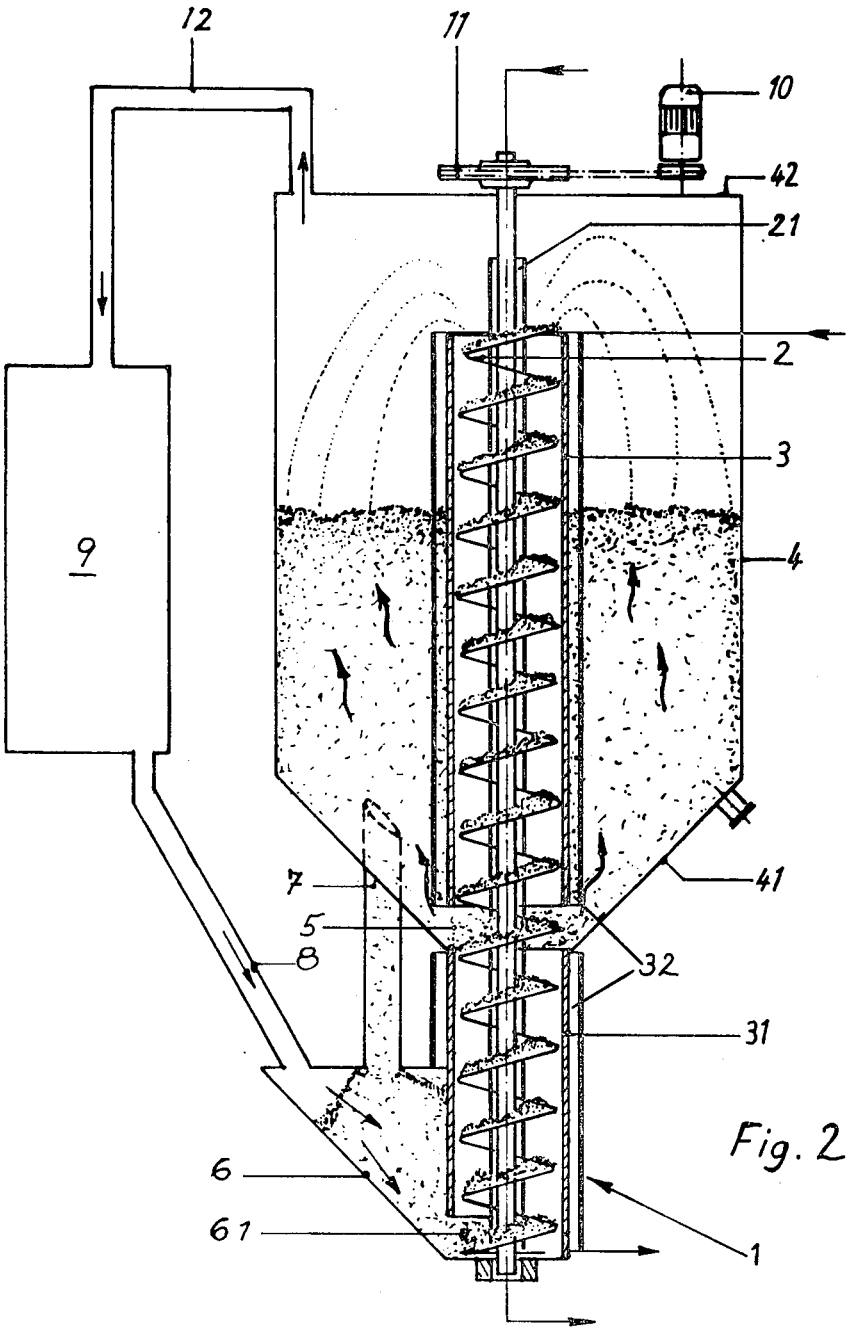
FIG. 2 is a view similar to FIG. 1 but also illustrating means for heating the jacket and the conveyor screw of the screw conveyor; and, FIG. 3 is a diagrammatic view illustrating an assembly of the units of FIGS. 1 or 2.

Referring now to FIG. 2, it may be seen that heating arrangements 32 or 21 can be provided which respectively heat the jacket 3 and the conveyor screw 2. When this expendient is resorted to, the drying procedure is further enhanced and expedited. The heating arrangements 32 and 21 can be of any conventional construction. So, for instance, the heating arrangements 32 and 21 can be so constructed as to employ the electrical resistance heating principle. However, when it is desired to achieve a uniform temperature distribution, it is especially advantageous to utilize the principle of heat exchange in the heating arrangements 32 and 41, that is, to conduct a heat-exchange medium through the heating arrangements 32 and 21.

This additional heating of the conveyor screw 2 and of the jacket 3 causes not only a direct heating of the pulverulent material which slides along the same or is conveyed therewith, but also an additional heating of the drying air which also comes into contact with these heated components 3 and 2 of the apparatus.

Figure 3:
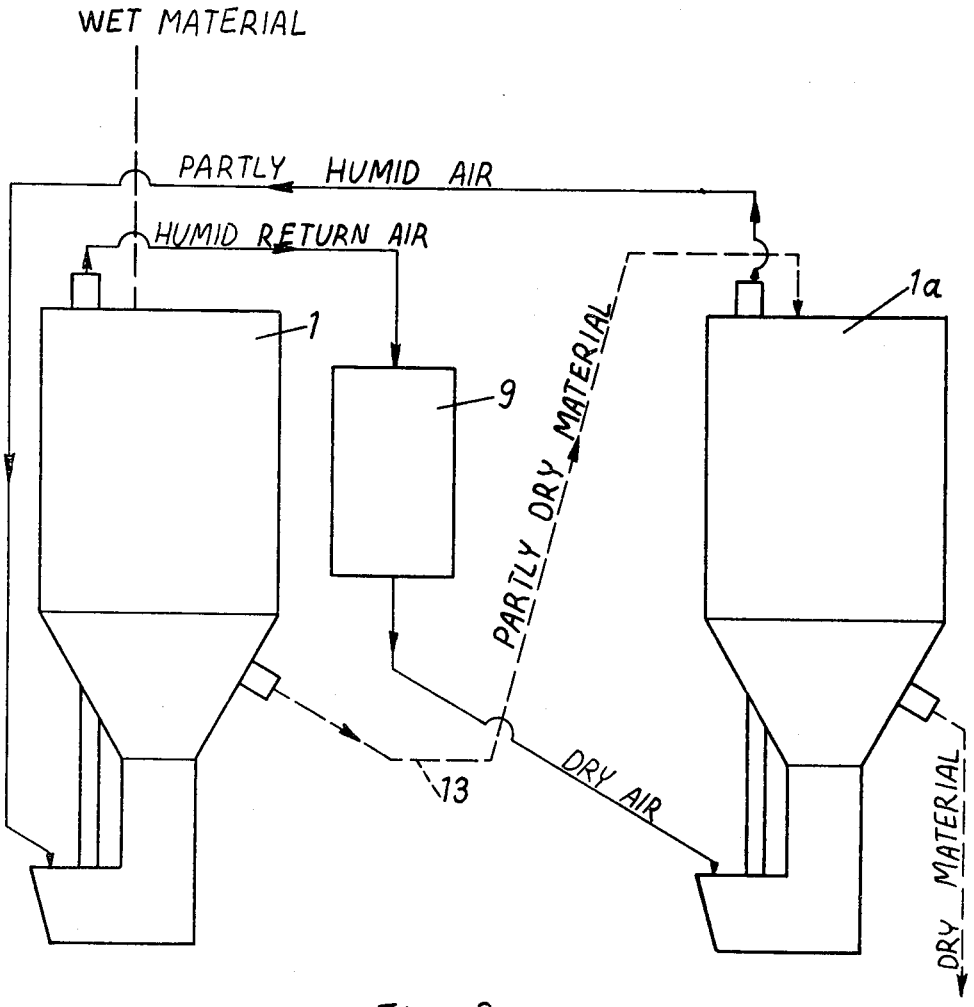

FIG. 3 reveals an example of arrangement of a plurality of the units disclosed in more detail in FIGS. 1 or 2, in tandem or in series with one another. Under these circumstances, the particulate material being dried is transported, by a transporting arrangement 13, from one of the units 1 to the other unit 1*a*, while the air delivered by the dehumidifying arrangement 9 is forced, in accordance with the countercurrent principle, through the battery of the units 1*a*, 1 and so on.

It will understood that each of the elements described above, or two or more together, may also find a useful application in other types of constructions differing from the types described above.

While the invention has been illustrated and described as embodied in a drying method and apparatus for pulverulent materials, it is not intended to be limited to the details shown, since various modifications and structural changes may be made without departing in any way from the spirit of the present invention. So, for instance, the apparatus of the present invention can also be profitably used for drying other than pulverulent bulk materials, such as granular or coarse particulate materials. Also, the construction of the apparatus may be different from that particularly revealed, so long as it is assured that the filling factor along the path of the forced advancement of the bulk material is substantially smaller than 1.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A method of drying particulate, especially pulverulent, materials, comprising the steps of collecting a quantity of the respective material to be dried in a silo; providing in said silo a rotating screw conveyor having a plurality of turns spaced from one another and forming therebetween a confined space; introducing a quantity of the material from said silo which is determined by the rate of rotation of said screw conveyor, into said screw conveyor so that only a portion of said confined space is filled thereby forming another portion of said confined space which is empty and so that when said screw conveyor rotates said quantity is conveyed along the latter with said another portion remaining free and unobstructed whereby said quantity has an exposed surface; and passing a drying gaseous medium through said screw conveyor so that it passes through said another portion of said confined space of said screw conveyor thereby contacting said exposed surface while simultaneously heating the material, both through direct contact on said exposed surface from above and by conduction of the heat of said gaseous medium through said screw conveyor to said portion from below, whereby the material is conveyed and simultaneously stirred and dried in the interior of said screw conveyor.

2. A method as defined in claim 1, wherein said passing step includes conveying the quantity of the material in a helical path; and wherein said passing step further includes conducting a stream of the drying medium in another helical path adjacent said helical path between said locations.

3. A method as defined in claim 1, wherein said passing step includes introducing a drying gaseous medium directly into said screw conveyor without preceding introduction of the same into said silo.

4. An apparatus for drying particulate, especially pulverulent, materials, comprising a silo for holding said particulate material to be dried; a screw conveyor having a plurality of turns spaced from one another and forming therebetween a confined space; means for introducing a quantity of said particulate material from said silo into said screw conveyor so that only a portion of said confined space is filled thereby forming another portion of said confined space which is not filled with said particulate material, and so that when said screw conveyor rotates said quantity is conveyed along said screw conveyor with said another portion remaining free and unobstructed whereby said quantity has an exposed surface; and means for passing a drying gaseous medium through said screw conveyor so that it passes through said another portion of said screw conveyor thereby contacting said exposed surface while simultaneously heating said quantity both through direct contact from above and by conduction of the heat of said gaseous medium through said screw conveyor to said portion from below, whereby the particulate material is conveyed and simultaneously stirred and dried in the interior of said screw conveyor.

5. An apparatus as defined in claim 4, wherein said screw conveyor includes a conveyor screw and a jacket surrounding said conveyor screw; and wherein said introducing means includes at least one opening in said jacket which communicates the interior of said jacket with said silo at an elevation of the latter where the body of the material is present.

6. An apparatus as defined in claim 4, wherein said silo and said screw conveyor constitute a unit; further comprising at least one additional unit similar to and separate from said unit, and means for transferring the material from one to the other of said units; and wherein said passing means is operative for introducing the drying medium into said other unit and for conducting the drying medium from said other unit, following the passage therethrough, into said one unit for passage through the latter.

7. An apparatus as defined in claim 5, further comprising means for heating said conveyor screw and means for heating said jacket.

8. An apparatus as defined in claim 4, wherein said screw conveyor comprises a conveyor screw; a jacket;

at least one lower opening, operative for admitting said gaseous medium and said particulate material; and at least one upper opening, operative for admitting said particulate matter from said silo and for allowing a portion of said gaseous medium to enter said silo.

9. An apparatus as defined in claim 5; further comprising means for rotating said conveyor screw about an axis; and wherein said at least one opening has such a size that only such amount of said particulate material can penetrate therethrough as will only partially fill the space.

10. An apparatus as defined in claim 4, wherein said passing means is arranged so that a drying gaseous medium is directly introduced into said screw conveyor without preceding introduction of the same into said silo.

* * * * *